United States Patent [19]

DuFresne

[11] Patent Number: 4,521,209

[45] Date of Patent: Jun. 4, 1985

[54] APPARATUS AND METHOD FOR TRANSVERSE FOLDING OF WEBS

[75] Inventor: Allen J. DuFresne, Green Bay, Wis.

[73] Assignee: Paper Converting Machine Company, Green Bay, Wis.

[21] Appl. No.: 487,569

[22] Filed: Apr. 22, 1983

[51] Int. Cl.[3] ..... B65H 45/22

[52] U.S. Cl. ..... 493/432; 493/418; 493/424; 493/450

[58] Field of Search ..... 493/254, 353, 369, 371, 493/418, 424, 429, 434, 435, 450, 442, 937, 960

[56] References Cited

U.S. PATENT DOCUMENTS

| | | | |
|---|---|---|---|
| 1,873,102 | 8/1932 | Bechman | 493/435 |
| 1,974,149 | 9/1934 | Christman | 493/418 |
| 2,353,445 | 7/1944 | Crafts | 493/429 |
| 2,846,215 | 8/1958 | Supligeau | 493/418 |
| 3,096,977 | 7/1963 | Winkler et al. | 493/424 |
| 3,363,896 | 1/1968 | McKindary | 493/418 |
| 3,689,061 | 9/1972 | Nystrand | 493/418 |

*Primary Examiner*—W. D. Bray

*Attorney, Agent, or Firm*—Tilton, Fallon, Lungmus & Chestnut

[57] ABSTRACT

A method and apparatus for transverse folding of web segments to provide napkins, hankies, or the like, in which first and second folding rolls are equipped with vacuum ports selectively actuatable to provide a transverse fold, the second folding roll being operated at a surface speed slower than the first.

12 Claims, 17 Drawing Figures

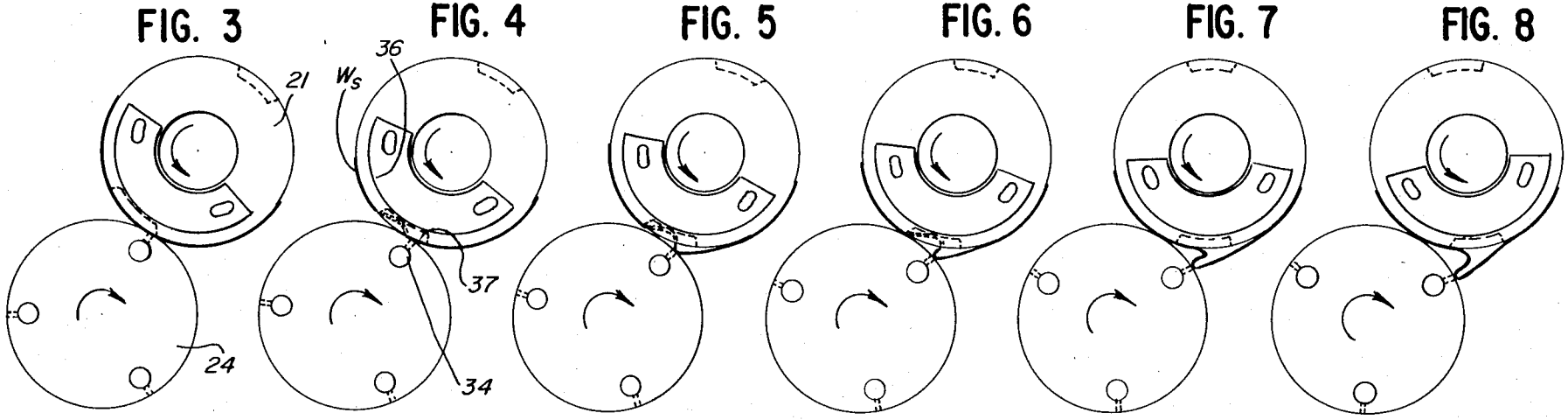
FIG. 3
FIG. 4
FIG. 5
FIG. 6
FIG. 7
FIG. 8
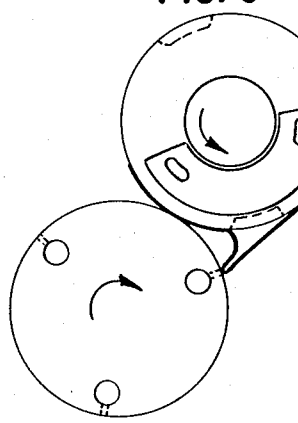
FIG. 9
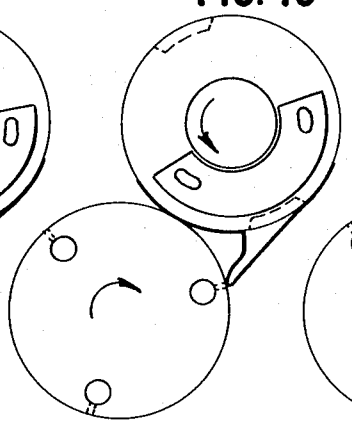
FIG. 10
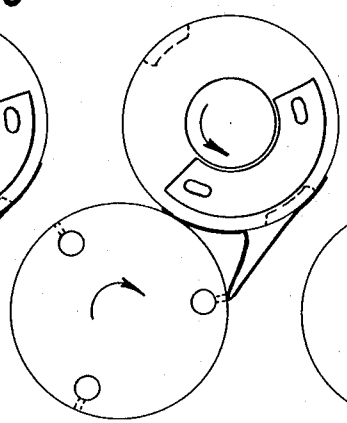
FIG. 11
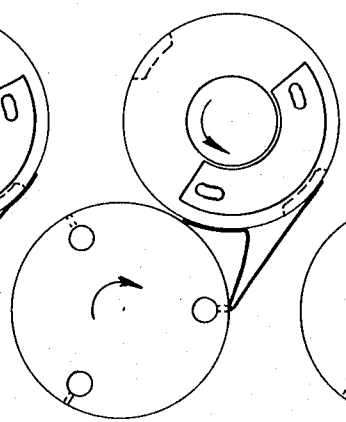
FIG. 12
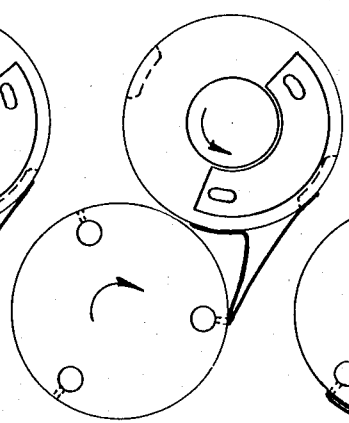
FIG. 13
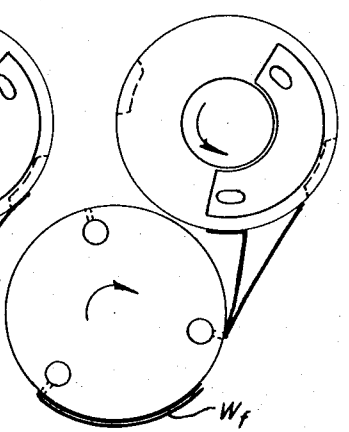
FIG. 14

APPARATUS AND METHOD FOR TRANSVERSE FOLDING OF WEBS

BACKGROUND AND SUMMARY OF INVENTION

This invention relates to an apparatus and method for the transverse folding of webs such as those made into napkins, hankies, or the like. Representative showings of the prior art can be seen in co-owned U.S. Pat. Nos. 1,566,079, 3,689,061 and 3,870,292.

In the process of producing stacks of transverse folded napkins it is necessary to stop the motion of the napkins in the direction parallel to the plane of the napkins. Stopping this motion causes erratic stacking depending upon the velocity of the napkins. This velocity can limit napkin folder operating speed by causing unacceptable stack quality. Historically, the velocity of motion which had to be removed to create a stack of napkins was the same as the velocity of the web entering the machine.

According to the invention, a pair of vacuum equipped rolls are provided with the second roll in the path of travel of the web segment being rotated at a surface speed slower than the first vacuum equipped roll of the pair. I refer to this invention as "slow speed folding rolls".

The slow-speed folding rolls produce a finished napkin velocity in the direction parallel to the plane of the napkins which is significantly less than the velocity of the web entering the machine. This means that:

1. At a given rate of napkin production, the velocity which must be removed from the napkins when they are stacked is significantly reduced yielding improved stack quality with slow-speed folding rolls.
2. If the machine is run at the maximum acceptable finished napkin velocity which yields acceptable stack quality, it will produce more napkins per minute with slow-speed folding rolls.

In addition, reducing the speed of the folding rolls reduces the radial acceleration forces which act to remove the folded napkins from the folding rolls by overcoming the vacuum system forces which act to hold the folded napkins securely on the folding rolls. The vacuum system forces are limited by natural laws which are unavoidable. The slow-speed folding rolls permit higher napkin production rates than conventional folders by reducing the acceleration forces which the limited vacuum forces must overcome.

The invention is described in conjunction with the accompanying drawing, in which FIG. 1 is a side elevational view, somewhat schematic, of the preferred embodiment of the invention utilizing three vacuum-equipped rolls so as to produce a double transverse fold;

FIGS. 3–14 (on the second sheet of drawing) are schematic side elevational views of the top two rolls of FIG. 1 with each succeeding view showing the topmost roll advanced 10° in rotation.

DETAILED DESCRIPTION

Figure 2:
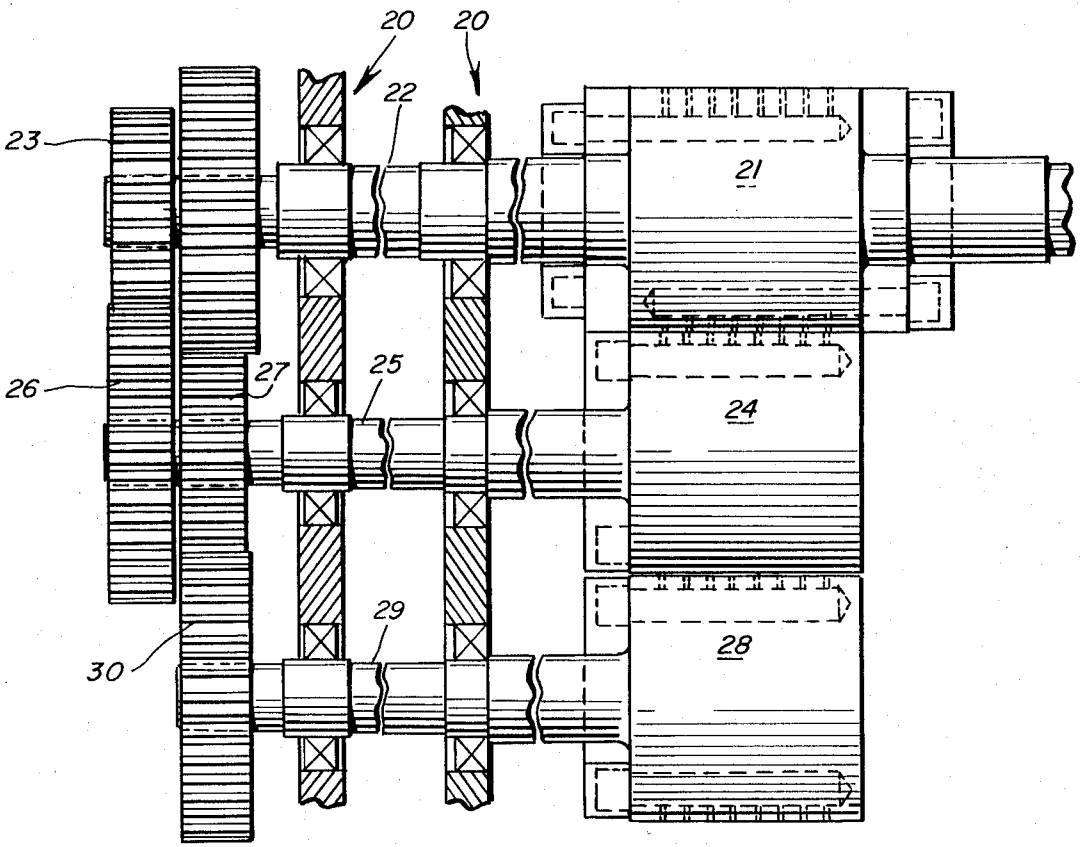
FIG. 2 is a fragmentary end elevational view showing particularly the drive for the rolls.
Figure 1:
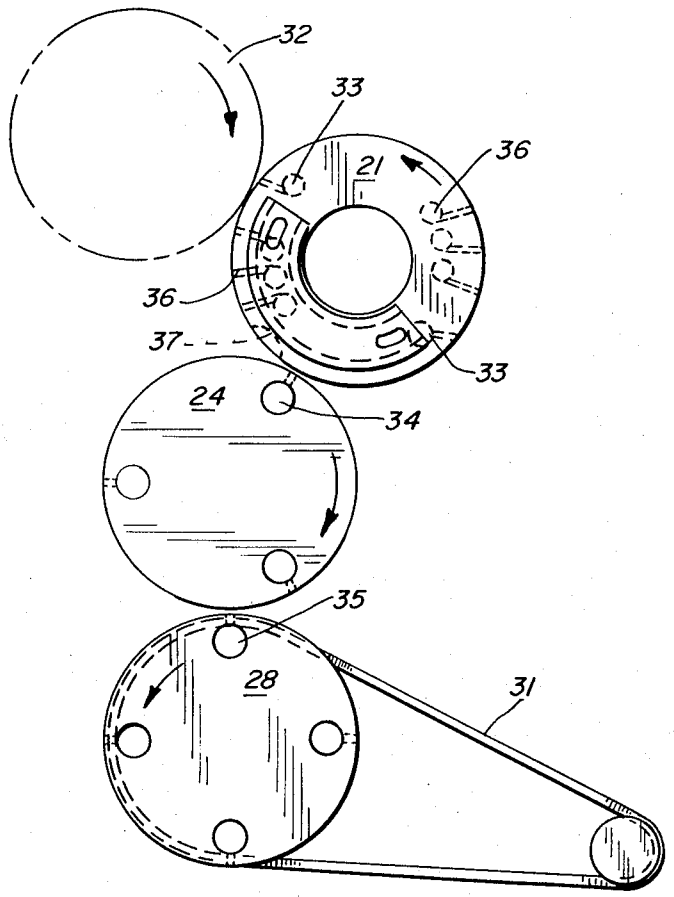

Referring now to the first drawing sheet and particularly to FIG. 2, the numeral 20 designates generally a frame. In accordance with established practice, the frame rotatably supports a vacuum-equipped carrier roll 21 which is equipped with a shaft 22 and a gear 23 outboard of the frame. In the specific illustration given, the gear 23 has 36 teeth.

Still referring to FIG. 2, the numeral 24 designates a transverse roll which is the second in the path of travel of a web segment and is again equipped with a shaft 25 carried in suitable bearings within the frame 20 and is equipped with a driven gear 26 meshing with the gear 23. In the illustration given, the gear 26 has 54 teeth.

Still referring to FIG. 2, it is seen that the transverse roll shaft 25 carries a second gear 27. In the illustration given, this gear has 39 teeth. This cooperates with the gear 30 on shaft 29 of the folding roll 28 (the bottommost roll). The gear 30 in the illustration given has 52 teeth.

From the foregoing, it will be seen that the transverse roll 24 operates at two-third the speed of the carrier roll, viz., 36/54. Further, the folding roll operates at three-quarters of the speed of the transverse roll, viz., 39/52. Thus, overall, there is a 50% reduction in speed of web material proceeding through the three rolls 21, 24 and 28 in the series presented.

The numeral 31 refers to a takeaway mechanism for folded web units such as napkins and can be seen in greater detail in co-owned U.S. Pat. No. 4,360,194. The takeaway mechanism 31 is arranged to strip folded web units from the folding roll 28 and deposit them on a horizontally traveling conveyor in a series of substacks which are thereafter accumulated into a stack. At the point in the operation when the folded web units must come to a stop—whether as individual units or substacks of units—there is an abrupt velocity change to zero. It is this velocity change which has limited the production speed of folding machines in the past.

In the operation of the invention, a web is introduced into a nip between the carrier roll 21 and a cutoff roll 32 also rotatably carried by the frame 20 in conventional fashion. These rolls cooperate to provide a series of web segments which are carried on the carrier roll by selectively actuating the vacuum ports 33 provided in the carrier roll. Also provided in conventional fashion in the transverse roll 24 are vacuum ports 34.

Reference is now made to the second sheet of drawing and the views presented therein FIGS. 3–14. These views illustrate the process of developing a transverse fold by the coaction of the carrier roll 21 and the transverse roll 24.

As indicated previously, the showings in the sequence depicted in FIGS. 3–14 involve rotating the carrier roll 21 10° between each successive showing. The transverse roll 24 which has a slower surface speed than the carrier roll 21 and is shown of the same diameter as the carrier roll rotates 6°, 40′ between each successive showing. As can be appreciated from the sequence, the vacuum port 34 (see FIG. 4) has engaged the mid-portion of the length of the web segment $W_s$ and has caused it to move with the periphery of the transverse roll 24. Inasmuch as the transverse roll 24 is rotating more slowly, i.e., at a slower surface speed, there is a slight accumulation of web material just rearward of the point of vacuum application by the port 34. To prevent this from becoming wrinkled, a recess 37 is provided in the surface of the carrier roll 21. The recess 37 cooperates with the additional vacuum ports 36 provided in the carrier roll 21 to secure in original position the tail portion of the web segment $W_s$.

The remaining views in the sequence FIG. 3–FIG. 14 illustrate the development of the first transverse fold which is provided by selectively opening and blanking the vacuum ports relative to a source of vacuum (not shown) but which is conventional in this art. Ultimately (see FIG. 14) a web segment has become fully transversely folded to become a folded web unit as at $W_f$. In certain installations, as for cocktail napkins, for example, this is the extent of the transverse folding required and the product is then complete.

Figure 15:
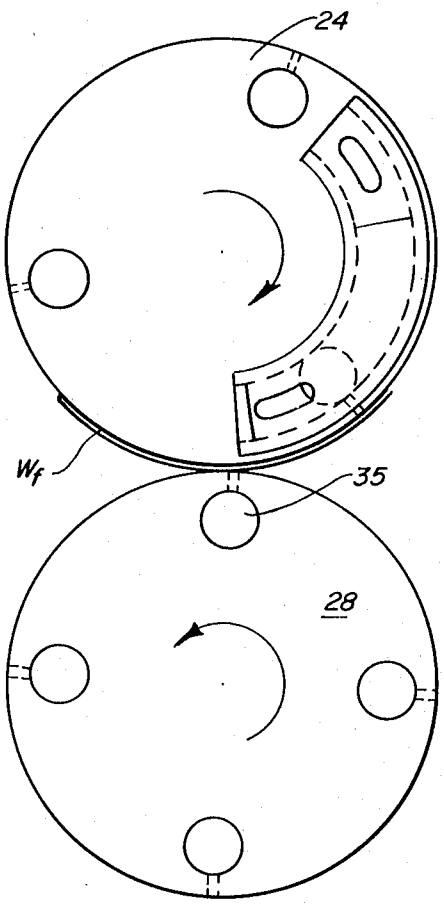
FIGS. 15–17 are side elevational views of the bottom two rolls showing the sequence of developing of a double folded web unit and with FIG. 17 showing an alternative form of takeaway mechanism.
Figure 16:
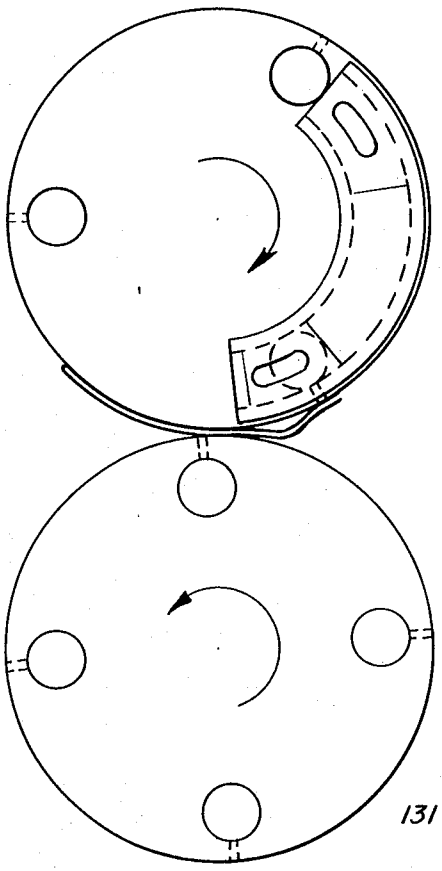
Figure 17:
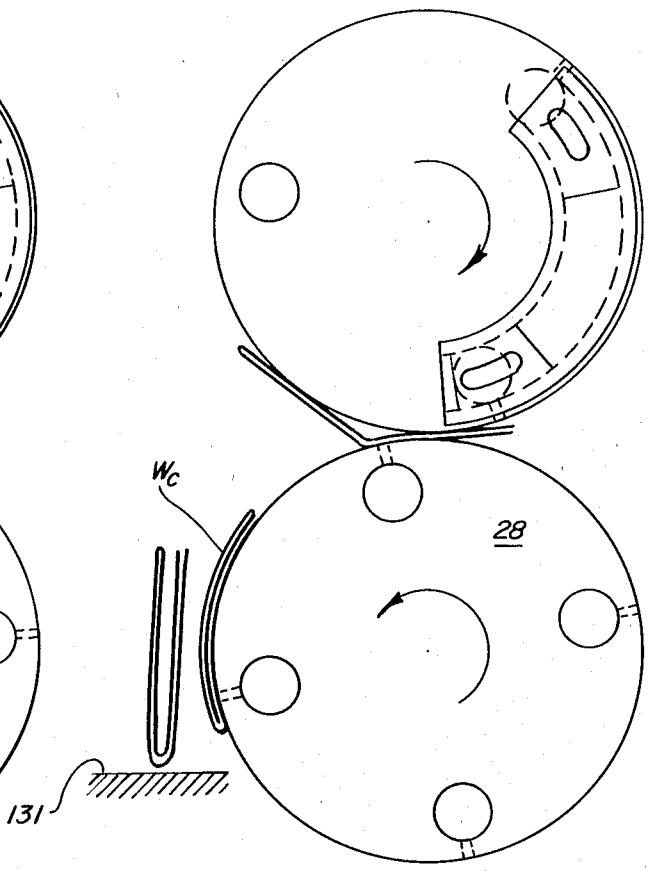

Where, however, double transverse folding is desired, the folding roll 28 is employed and the relationship of this roll to the transverse roll 24 can be seen in the sequence depicted in FIGS. 15–17. In FIG. 15, the once folded web unit $W_f$ is seen at the bottom portion of the periphery of transverse roll 24 and with its mid-length portion about to be engaged by one of the vacuum ports 35 in the folding roll 28. This actual engagement is seen in FIG. 16 which depicts the beginning of the second transverse fold. Ultimately, the fold is completed as seen at $W_c$ in FIG. 17. Thereafter, the completed unit is removed and to illustrate an alternative form of takeaway mechanism, a stop 131 is depicted schematically, much in the form seen in U.S. Pat. No. 3,870,292. This conventional form of takeaway mechanism makes use of packer fingers (not shown) which ride in grooves in the folding roll 28 and strip the web units such as napkins horizontally away from the folding roll 28. This results in the shock of a stop in velocity of the relatively flimsy web unit which heretofore has been a speed limitation on folding roll apparatus. Now, however, this limitation is avoided by virtue of the fact that the speed of the folded web unit just prior to being stopped in a direction parallel to its plane is substantially lower than the entering web velocity, viz., the predetermined speed of the web.

It will be appreciated that the invention is not limited to the specific illustration given. For example, the rolls need not be of the same diameters as pictured. Further, they need not have the shown arrangement of vacuum ports, viz., two sets of vacuum ports 31 and 36 in the carrier roll 21, three vacuum ports 34 in the transverse roll 24, and four vacuum ports 28 in the carrier roll 28. There does, however, have to be at least two vacuum ports in the carrier roll 21 in order to provide a space for the development of a subsequent web segment when a previous web segment is being removed by the transverse roll 24. On the other hand, this space limitation is not characteristic of either the transverse roll 24 nor the folding roll 28 because additional space is provided by virtue of the fact that the web segment has its length halved incident to the transfer from one roll to the succeeding roll. It is this space which is utilized to advantage in the invention and it is surprising that notwithstanding the long use of vacuum folding rolls for making napkins and the like that no one appreciated the benefits of reducing this extra space between folded products and thereby reducing the speed of the folding apparatus so as to avoid the potential wrinkling of web units when they come against a fixed stop for stacking.

The following is an example of the usefulness of the slow-speed folding rolls in reaching higher production rates of napkins and similar products.

Assume:

(1) Product is 9″×9″ napkin or hanky.
(2) Longitudinal V-fold reduces product to 9″ long×4½″ wide.
(3) First transverse fold reduces product to 4½″ long×4½″ wide.
(4) Second transverse fold reduces product to 2¼″ long×4½″ wide.
(5) All rolls are 18″ circumference:
Carrier roll 21
Transverse roll 24
Folding roll 28

Prior Art—Conventional Design:

(1) Design information:
(a) All rolls (carrier, transverse, folding) have 2 vacuum ports diametrically opposite.
(b) All rolls have the same surface speed which is also the velocity of the incoming web of paper.
(2) Experience information:
(a) This machine will operate reliably and make satisfactory stacks of products at a production rate of 1000 products/minute.
(b) Vacuum is adequate to hold products on rolls and make transverse folds at 1000 products/minute.
(c) The kinetic energy of the products can be removed when stopping and stacking the products with acceptable finished stack and product quality at 1000 products/minute.
(3) Calculation of acceptable speeds:
The acceptable speed of this prior art machine is:

$$V = 1000 \frac{\text{(Products)}}{\text{(Minute)}} \times 9 \frac{\text{(inches)}}{\text{(Product)}} \times \frac{1}{12} \frac{\text{(feet)}}{\text{(inch)}}$$

$$V = 750 \text{ feet/minute}$$

New Design with Slow-Speed Folding Rolls:

(1) Design information
(a) Vacuum ports:
Carrier roll has 2 vacuum ports, diametrically opposite.
Transverse roll has 3 vacuum ports, evenly spaced around roll circumference.
Folding roll has 4 vacuum ports, evenly spaced around roll circumference.
(b) Surface speed of rolls:
Carrier roll surface speed is same as speed of incoming web ($V_o$).
Transverse roll surface speed ($V_1$) is ⅔ Speed of carrier roll.
Folding roll surface speed ($V_2$) is 2/4 speed of carrier roll.
(2) Calculation of maximum production rate
Since, from prior art, we know that a conventional machine will product acceptable product at a delivery velocity (V) of 750 feet/minute, a new design machine with slow-speed folding rolls will produce acceptable product when its delivery velocity ($V_2$) equals 750 feet/minute.
Therefore:
$V_2$=750 feet/minute
$V_2$=2/4 $V_o$ (from Design information)
Therefore:
750 feet/minute=2/4 $V_o$
$V_o$=1500 feet/minute
And:

$$X \frac{\text{(Products)}}{\text{(Minute)}} \times 9 \frac{\text{(inches)}}{\text{(product)}} \times \frac{1}{12} \frac{\text{(feet)}}{\text{(feet)}} = V_o$$

$$\text{Therefore: } \frac{9}{12} x = V_o$$

$$x = \frac{12}{9} V_o$$

$$x = \frac{12}{9} (1500)$$

$$x = 2000 \text{ products/minute}$$

The new design machine with slow-speed folding rolls will produce twice as many products/minute as the prior art machine with equal product quality.

It should be appreciated that there is a limit to the usefulness of the invention. Theoretically, the rolls could be slowed down enough to remove all gaps between products. This would yield theoretical maximum advantages from this idea as follows:

(1) One transverse fold
Production rate 2 times prior art machine.

(2) Two transverse folds
Production rate 4 times prior art machines.

In actual practice, one could not expect to reach this theoretical maximum increase in production rate over prior art machines because:

(1) Some gap between products is advantageous and desirable when making stacks and substacks.

(2) High speed differences between rolls will tend to produce quality defects at high production rates. Experience with different machine designs and paper webs will be needed to learn optimum slowing of rolls without unacceptable quality deterioration.

While in the foregoing specification a detailed description of the invention has been set down for the purpose of explanation, many variations in the details herein given may be made by those skilled in the art without departing from the spirit and scope of the invention.

I claim:

1. A folder for transversely folding web material comprising a frame, a first vacuum roll rotatably mounted on said frame and equipped with at least two vacuum ports spaced equally circumferentially about the surface of said first vacuum roll for maintaining segments of said web material against the roll surface and means operatively associated with said first vacuum roll for selectively applying and withdrawing vacuum from said ports, and a second vacuum roll rotatably mounted on said frame adjacent said first vacuum roll and equipped with vacuum port means adapted to receive said web segments therefrom and transversely fold the same incident to transfer of each web segment from said first to said second vacuum roll, means for rotating said second vacuum roll at a surface speed slower than the surface speed of said first vacuum roll.

2. The apparatus of claim 1 in which a third vacuum roll is rotatably mounted on said frame and means for rotating said third vacuum roll at a surface speed slower than the surface speed of said second vacuum roll.

3. The structure of claim 1 in which said first and second vacuum rolls have the same diameter.

4. The structure of claim 3 in which the said second vacuum roll has a greater number of vacuum ports than said first vacuum roll.

5. The structure of claim 3 in which said means for rotating said rolls includes gears arranged to step down the speed in rotating said second vacuum roll from the gear associated with said first vacuum roll.

6. The structure of claim 1 in which said first vacuum roll is equipped with a recess and additional vacuum ports intermediate said at least two vacuum ports.

7. A folder for transversely folding web material comprising a frame, a first vacuum roll rotatably mounted on said frame and equipped with at least two vacuum ports spaced equally circumferentially about the surface of said first vacuum roll for maintaining segments of web material against the roll surface and means operatively associated with said first vacuum roll for selectively applying and withdrawing vacuum from said ports, a second vacuum roll rotatably mounted on said frame adjacent said first vacuum roll and equipped with vacuum ports adapted to receive said web segments therefrom and transversely fold the same incident to transfer of each web segment from said first vacuum roll to said second vacuum roll, and means for rotating said second vacuum roll at a surface speed slower than the surface speed of said first vacuum roll, a third vacuum roll rotatably mounted on said frame adjacent said second vacuum roll and equipped with vacuum ports adapted to receive folded web segments from said second vacuum roll and transversely fold the same incident to transfer of each folded web segment from said second vacuum roll to said third vacuum roll, means for rotating said third vacuum roll at a surface speed slower than the surface speed of said second vacuum roll, and means for removing each folded web segment from said third vacuum roll and stopping the motion of the same in a direction parallel to the plane of each folded web unit.

8. The structure of claim 7 in which said first vacuum roll is equipped with a recess and additional vacuum ports intermediate said at least two vacuum ports.

9. A folder for transversely folding web material comprising a frame, a first vacuum roll rotatably mounted on said frame and equipped with at least two vacuum ports spaced equally circumferentially about the surface of said first vacuum roll for maintaining segments of web material against the roll surface and means operatively associated with said first vacuum roll for selectively applying and withdrawing vacuum from said ports, and a second vacuum roll rotatably mounted on said frame adjacent said first vacuum roll and equipped with vacuum ports adapted to receive said web segments from said first vacuum roll and transversely fold the same incident to transfer of each web segment from said first vacuum roll to said second vacuum roll, means for rotating said second vacuum roll at a surface speed slower than the surface speed of said first vacuum roll, said first vacuum roll being equipped with a recess and additional vacuum ports intermediate said at least two vacuum ports.

10. A method of transversely folding web material for development of stacks of the same comprising:

sequentially advancing web segments on a vacuum equipped carrier roll rotating at a predetermined surface speed, sequentially removing said web segments from said carrier roll while transversely folding the same to form generally planar folded web units and advancing said folded web units on a vacuum equipped transverse folding roll rotating at a surface speed less than said predetermined speed, and stopping the velocity of said web units in a direction parallel to the plane of said web units to form a stack.

11. The method of claim 10 in which said folded web units are transferred from said vacuum equipped transverse folding roll to a vacuum equipped folding roll for developing a second transverse fold in said web unit prior to stopping the velocity thereof.

12. The method of claim 10 in which said vacuum equipped carrier roll is equipped with a recess and vacuum ports for accommodating a relaxed portion of the web incident to the removing of said web segments from said carrier roll.

* * * * *